US011291894B2

(12) United States Patent
Payne

(10) Patent No.: US 11,291,894 B2
(45) Date of Patent: Apr. 5, 2022

(54) PUTTER HOLDING ASSEMBLY

(71) Applicant: Kenneth Payne, Zellwood, FL (US)

(72) Inventor: Kenneth Payne, Zellwood, FL (US)

( * ) Notice: Subject to any disclaimer, the term of this patent is extended or adjusted under 35 U.S.C. 154(b) by 266 days.

(21) Appl. No.: 16/582,834

(22) Filed: Sep. 25, 2019

(65) Prior Publication Data

US 2021/0086046 A1 Mar. 25, 2021

(51) Int. Cl.
*A63B 55/10* (2006.01)
*A63B 55/50* (2015.01)
*A63B 55/60* (2015.01)

(52) U.S. Cl.
CPC ..... *A63B 55/10* (2013.01); *A63B 55/50* (2015.10); *A63B 55/61* (2015.10)

(58) Field of Classification Search
CPC ..... A63B 55/10; A63B 55/50
USPC ..... 224/915, 274; 206/315.2
See application file for complete search history.

(56) References Cited

U.S. PATENT DOCUMENTS 1,553,016 A * 9/1925 Guldin ..... A47G 25/12 211/63
1,670,962 A * 5/1928 Hall ..... B60R 7/08 211/123
2,426,113 A * 8/1947 Northcutt ..... B60R 7/12 296/37.13
2,448,404 A * 8/1948 Ackerman ..... A45C 13/40 224/610
2,761,691 A * 9/1956 George ..... B62B 1/262 280/47.19
3,935,874 A * 2/1976 Cohen ..... A45B 25/24 135/16
4,522,300 A * 6/1985 Hamblet ..... A45B 11/00 135/16
4,664,382 A * 5/1987 Palmer ..... A63B 55/00 473/288
4,887,786 A * 12/1989 Stokes ..... A45B 11/00 248/512
4,944,396 A * 7/1990 Larkin ..... A63B 55/40 206/315.6
5,088,600 A 2/1992 Kopp
5,213,364 A * 5/1993 Theckston ..... A63B 55/61 280/769
5,238,109 A * 8/1993 Smith ..... A63B 55/40 206/315.2
5,275,278 A * 1/1994 Henry ..... A63B 55/40 206/315.6

(Continued)

FOREIGN PATENT DOCUMENTS

FR 2489128 A1 * 3/1982 ..... A47G 25/12
GB 259794 A * 10/1926 ..... A63B 55/10

(Continued)

*Primary Examiner* — Kimberly T Wood

(57) ABSTRACT

A putter holding assembly for storing a putter golf club on a golf cart includes a tube for accommodating a handle of a putter golf club having a head of the putter golf club being exposed for gripping. A receiver is provided and the receiver is coupled to the tube. The receiver insertably receives the handle of the putter golf club when the handle of the putter golf club is inserted into the tube for storage. A pair of brackets is each positionable around the tube. Each of the brackets engages a structure on a golf cart for retaining the tube on the golf cart. A support is movably coupled to the tube and a towel is coupled to the support such that the towel is available to a golfer.

9 Claims, 6 Drawing Sheets

(56) References Cited

U.S. PATENT DOCUMENTS 5,390,916 A 2/1995 Govoni
5,613,603 A * 3/1997 Joh ..... A63B 55/00 206/315.6
5,775,513 A * 7/1998 Anthony ..... A63B 55/40 206/315.3
6,102,202 A * 8/2000 Jones ..... A63B 55/40 206/315.6
6,209,721 B1 * 4/2001 Sharpe ..... A63B 55/40 206/315.6
6,216,864 B1 * 4/2001 Chang ..... A63B 57/00 206/315.2
6,299,000 B1 * 10/2001 Cabrera ..... A47B 81/005 211/104
6,439,424 B1 * 8/2002 Threadgill, Jr. ..... A63B 47/002 221/185
6,494,427 B1 * 12/2002 Smith ..... A01D 34/001 224/401
D476,479 S 7/2003 Bailey
6,640,970 B1 * 11/2003 Townsend, Jr. ..... A45C 7/0045 206/315.2
D486,875 S * 2/2004 Hale ..... D21/796
D551,862 S * 10/2007 Gerry ..... D3/300
7,320,401 B1 * 1/2008 Chandler ..... A63B 55/40 206/315.2
7,854,664 B1 * 12/2010 Comrie ..... A63B 57/20 473/282
8,225,806 B1 * 7/2012 Simonelli ..... A45B 25/24 135/27
D668,876 S * 10/2012 Tice ..... D3/302
D669,953 S * 10/2012 Gold ..... D21/796
8,640,866 B1 * 2/2014 Dow ..... A63B 55/20 206/315.2
D738,099 S * 9/2015 Mosteller ..... D3/10
9,162,123 B2 * 10/2015 Enright ..... A63B 55/408
9,227,119 B2 * 1/2016 Jones ..... A63B 55/40
D764,802 S 8/2016 Lin
D768,546 S * 10/2016 Ingallinera ..... D12/133
D869,919 S * 12/2019 Tipton ..... D8/8
2001/0054595 A1 * 12/2001 Cabrera ..... A63B 57/60 211/70.2
2005/0000987 A1 * 1/2005 Heidenreich ..... A63B 55/40 224/274
2006/0208143 A1 * 9/2006 Romano ..... A63B 55/57 248/222.13
2007/0012585 A1 * 1/2007 Sugarek ..... A63B 55/10 206/315.3
2008/0146367 A1 * 6/2008 Cruz ..... A63B 57/207 473/286
2008/0169210 A1 * 7/2008 Heidenreich ..... A63B 55/408 206/315.2
2008/0190795 A1 * 8/2008 Shearon ..... A63B 55/10 206/315.2
2009/0308767 A1 * 12/2009 Brydon ..... A45B 11/00 206/315.3
2010/0071737 A1 * 3/2010 Gourdine ..... A45B 11/00 135/16
2012/0261447 A1 * 10/2012 Bryant ..... A63B 55/10 224/274
2013/0092572 A1 * 4/2013 Proulx ..... A63B 47/002 206/315.2
2014/0309053 A1 10/2014 Masse
2019/0224542 A1 * 7/2019 Hoss ..... F16M 13/022

FOREIGN PATENT DOCUMENTS

WO WO0102064 1/2001
WO WO-2006044846 A2 * 4/2006 ..... B62B 5/00
WO WO-2013184171 A1 * 12/2013 ..... A63B 55/20

* cited by examiner

PUTTER HOLDING ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to holding device and more particularly pertains to a new holding device for storing a putter golf club on a golf cart.

(2) Description of Related Art Including Information Disclosed Under 37 CFR 1.97 and 1.98

The prior art relates to holding device.

(h) BRIEF SUMMARY OF THE INVENTION

An embodiment of the disclosure meets the needs presented above by generally comprising a tube for accommodating a handle of a putter golf club having a head of the putter golf club being exposed for gripping. A receiver is provided and the receiver is coupled to the tube. The receiver insertably receives the handle of the putter golf club when the handle of the putter golf club is inserted into the tube for storage. A pair of brackets is each positionable around the tube. Each of the brackets engages a structure on a golf cart for retaining the tube on the golf cart. A support is movably coupled to the tube and a towel is coupled to the support such that the towel is available to a golfer.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
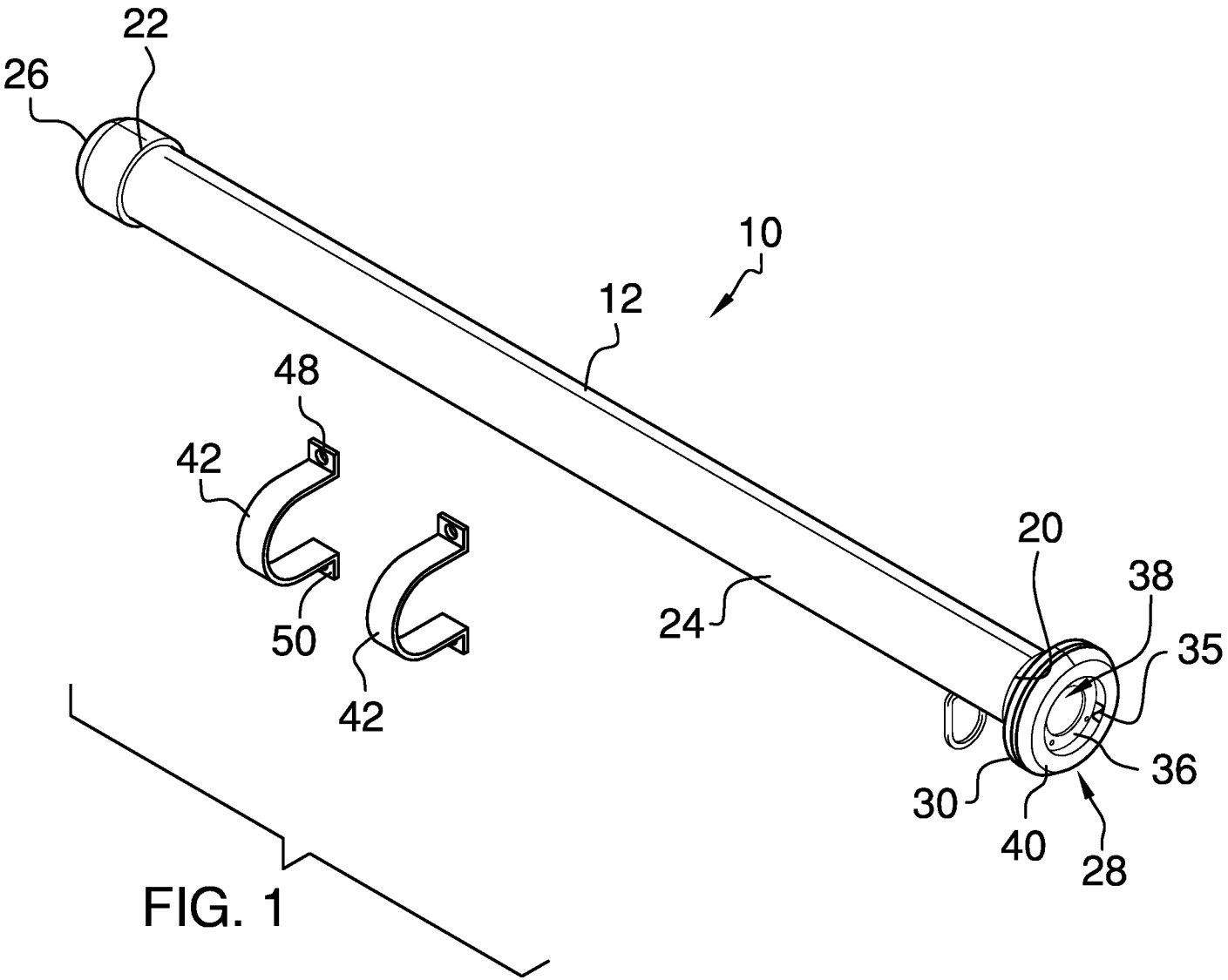
FIG. 1 is a perspective view of a putter holding assembly according to an embodiment of the disclosure.
Figure 2:
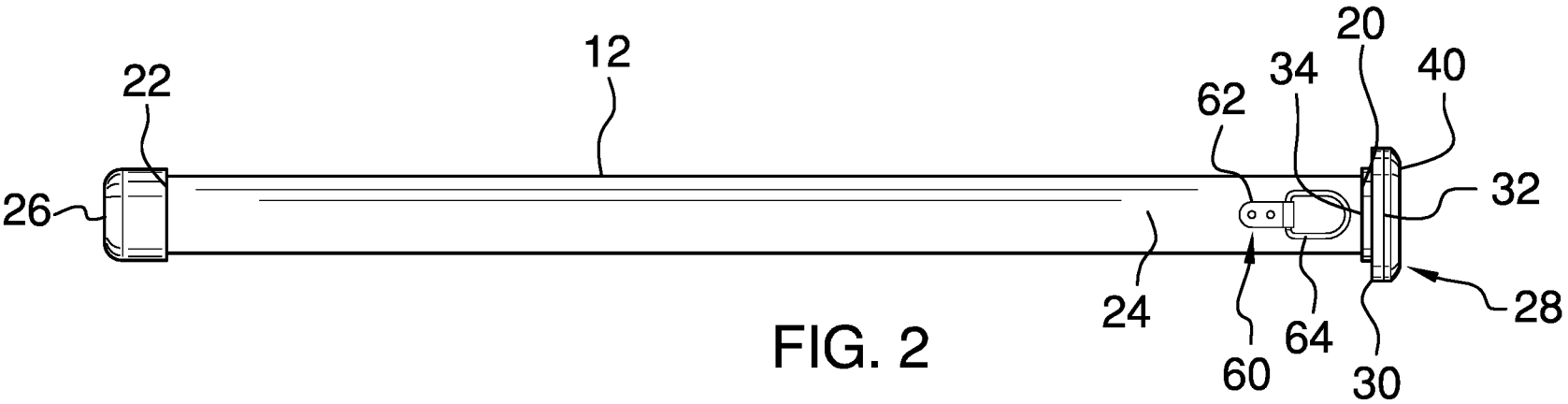
FIG. 2 is a bottom view of an embodiment of the disclosure.
Figure 3:
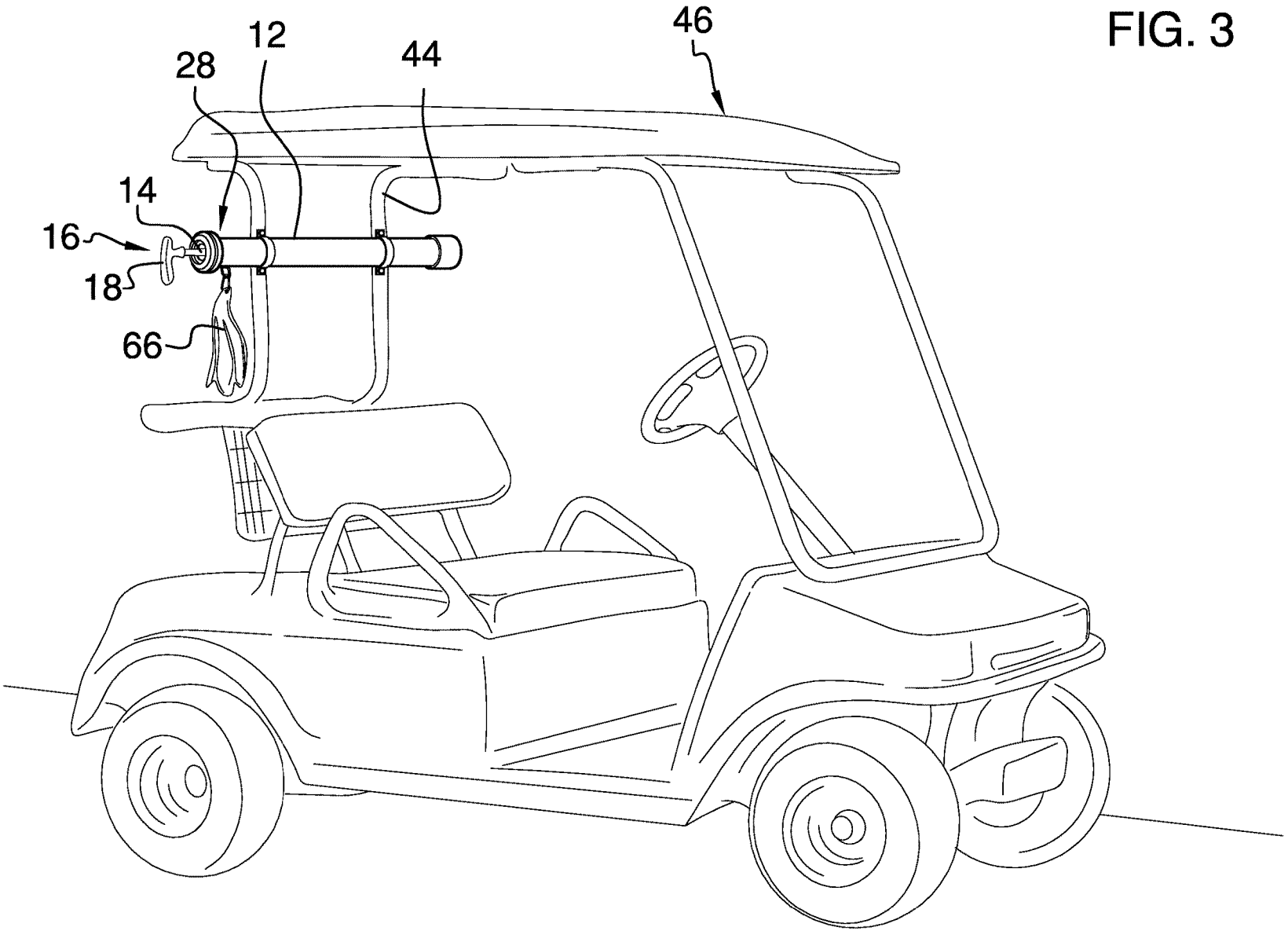
FIG. 3 is a perspective in-use view of an embodiment of the disclosure.
Figure 4:
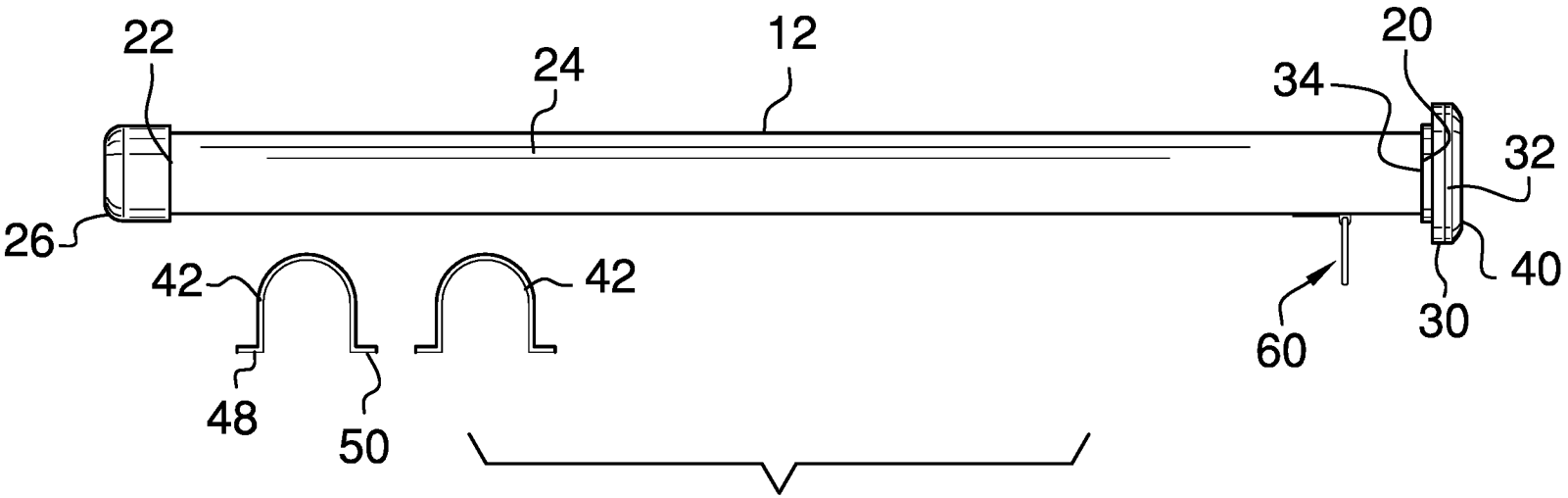
FIG. 4 is a right side view of an embodiment of the disclosure.
Figure 5:
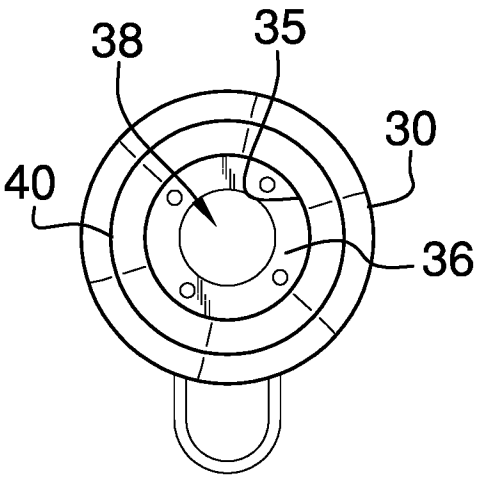
FIG. 5 is a front view of an embodiment of the disclosure.

With reference now to the drawings, and in particular to FIGS. 1 through 7 thereof, a new holding device embodying the principles and concepts of an embodiment of the disclosure and generally designated by the reference numeral 10 will be described.

As best illustrated in FIGS. 1 through 7, the putter holding assembly 10 generally comprises a tube 12 that has a length of at least 39.0 inches. In this way the tube 12 can accommodate a handle 14 of a putter golf club 16 having a head 18 of the putter golf club 16 being exposed for gripping. The tube 12 has a first end 20, a second end 22 and an outer wall 24 extending therebetween. A cap 26 is coupled to the second end 22 of the tube 12 for closing the second end 22. Each of the tube 12 and the cap 26 may be comprised of polyvinylchloride and each of the tube 12 and the cap 26 may comprise schedule 40 PVC.

A receiver 28 is provided and the receiver 28 is coupled to the tube 12. The receiver 28 insertably receives the handle 14 of the putter golf club 16 when the handle 14 of the putter golf club 16 is inserted into the tube 12 for storage. Moreover, the receiver 28 inhibits the putter golf club 16 from freely moving in the tube 12 or from falling out of the tube 12. The receiver 28 comprises a flange 30 that has a front side 32 and a back side 34, and the back side 34 is coupled around the first end 20 of the tube 12. The handle 14 of the putter golf club 16 is inserted through the flange 30 when the handle 14 of the putter golf club 16 is inserted into the tube 12. Additionally, the flange 30 has an inner bounding surface 36.

The receiver 28 includes a gasket 36 that is coupled to the inner bounding surface 36 of the flange 30 and the gasket 36 has an opening 38 extending therethrough. The gasket 36 is aligned with the front side 32 of the flange 30 and the gasket 36 is comprised of a resiliently deformable material, including but not being limited to, rubber, silicone or other similar material. Moreover, the opening 38 has a diameter that is at most equivalent to the diameter of the handle 14 of the putter golf club 16. In this way the gasket 36 frictionally engages the handle 14 of the putter golf club 16 when the handle 14 is inserted through the opening 38 in the gasket 36. In this way the putter golf club 16 is inhibited from bouncing in the receiver 28 and from sliding out of the receiver 28.

A cushion 40 is provided, the cushion 40 is coupled to the front side 32 of the flange 30 and the cushion 40 surrounds the inner bounding surface 36 of the flange 30. The cushion 40 is comprised of a resiliently compressible material, including but not being limited to, rubber, silicone or other similar material. The head 18 of the putter golf club 16 abuts the cushion 40 when the handle 14 of the putter golf club 16 is inserted into the tube 12.

A pair of brackets 42 is provided and each of the brackets 42 is positionable around the tube 12. Each of the brackets 42 engages a structure 44 on a golf cart 46 for retaining the tube 12 on the golf cart 46. In this way the putter golf club 16 is stored on the golf cart 46 without being positioned in a golf bag. Thus, a golfer does not have to search for the putter golf club 16 in the golf bag when the golfer is putting on a green. Each of the brackets 42 has a primary end 48 and a secondary end 50. Additionally, each of the brackets 42 is curved between the primary end 48 and the secondary end 50 thereby facilitating each of the brackets 42 to conform to curvature of the outer wall 24 of the tube 12. Each of the primary end 48 and the secondary end 50 of each of the brackets 42 is fastened to the structure 44 on the golf cart 46 having the tube 12 is horizontally oriented.

Figure 6:
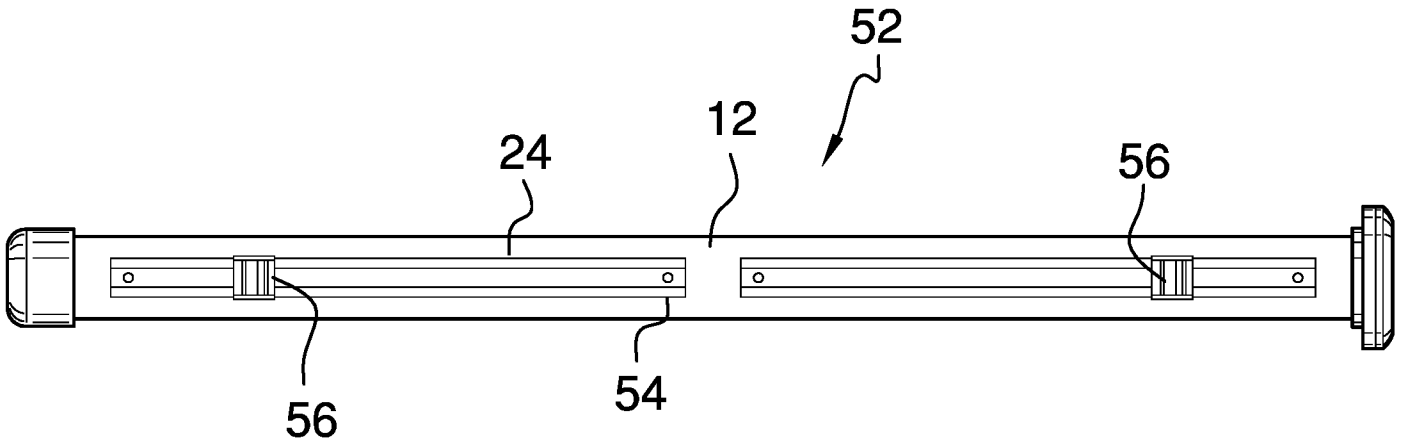
FIG. 6 is a bottom view of an alternative embodiment of the disclosure.
Figure 7:
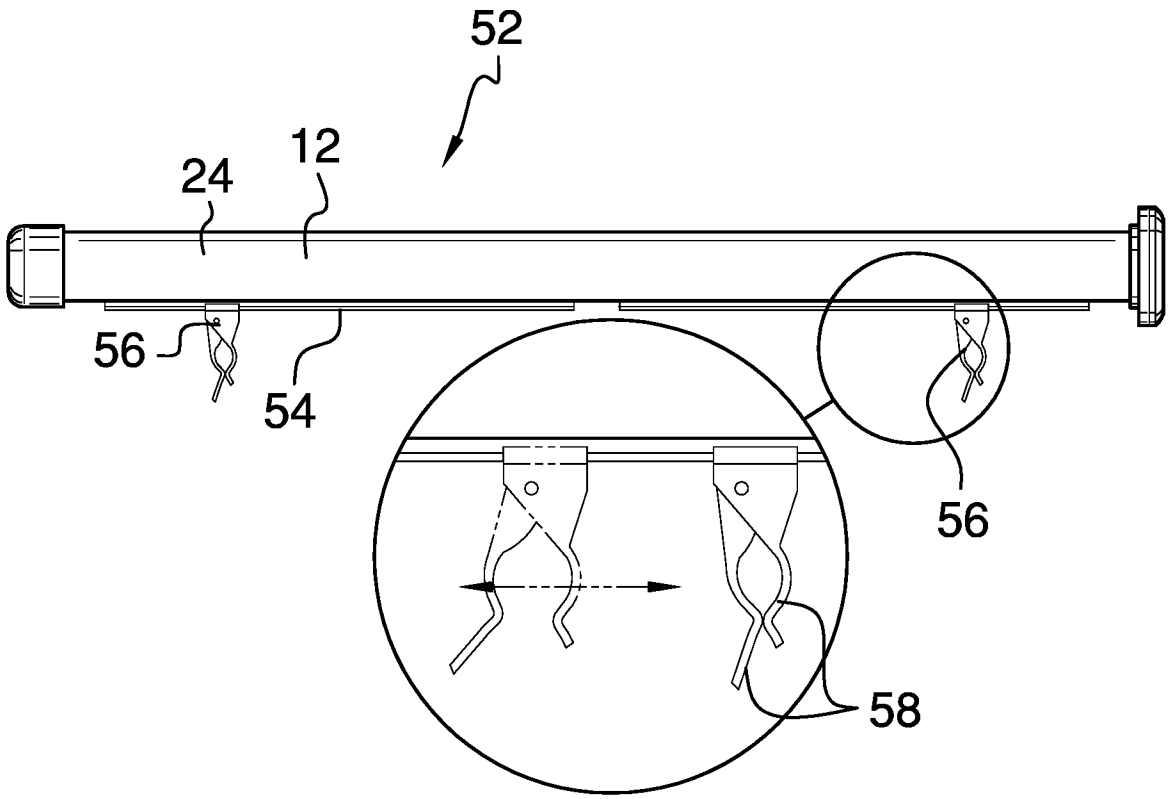
FIG. 7 is a right side view of an alternative embodiment of the disclosure.

In an alternative embodiment 52 as is most clearly shown in FIGS. 6 and 7, a rail 54 is coupled to the outer wall 24 of the tube 12. The rail 54 is oriented to extend substantially between the first end 20 and the second end 22 of the tube 12. Continuing in the alternative embodiment 52, a pair of clamps 56 is each slidably coupled to the rail 54. Each of the clamps 56 includes a pair of jaws 58 that are biased toward each other. The jaws 58 of each of the clamps 56 is urgeable away from each other. Additionally, the jaws 58 on each of the clamps 56 engages the structure 44 of the golf cart 46 for retaining the tube 12 on the structure 44 of the golf cart 46.

A support 60 is movably coupled to the tube 12 and the support 60 is positioned on the outer wall 24 of the tube 12. The support 60 is positioned closer to the first end 20 of the tube 12 than the second end 22 of the tube 12. Additionally, the support 60 is directed downwardly from the tube 12 when the tube 12 is mounted on the structure 44 of the golf cart 46. The support 60 may include a mounting bracket 62 that is attached to the tube 12 and a ring 64 that is movably suspended from the mounting bracket 62. A towel 66 is coupled to the support 60 such that the towel 66 is available to a golfer.

In use, the tube 12 is mounted to the structure 44 of the golf cart 46 such that the tube 12 is horizontally oriented. The handle 14 of the putter golf club 16 is inserted through the gasket 36 for storing the putter golf club 16 in the tube 12. In this way the putter golf club 16 is always readily available when the golfer is putting on the green. Moreover, the tube 12 facilitates the putter golf club 16 to be stored away from the golf bag. In this way the golfer does not have to search among other golf clubs to find the putter golf club 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A putter holding assembly being configured to store a putter in between holes of golf, said assembly comprising:

a tube for accommodating a handle of a putter golf club having a head of the putter golf club being exposed for gripping;

a receiver being coupled to said tube, said receiver insertably receiving the handle of the putter golf club when the handle of the putter golf club is inserted into said tube for storage;

a pair of brackets, each of said brackets being positionable around said tube, each of said brackets engaging a structure on a golf cart for retaining said tube on the golf cart;

a support being movably coupled to said tube; and a towel being coupled to said support wherein said towel is configured to be available to a golfer.

2. The assembly according to claim 1, wherein:

said tube has a length of at least 39.0 inches, said tube having a first end, a second end and an outer wall extending therebetween; and said assembly includes a cap being coupled to said second end of said tube for closing said second end.

3. The assembly according to claim 2, wherein said receiver comprises a flange having a front side and a back side, said back side being coupled around said first end of said tube, said flange having the handle of the putter golf club being inserted therethrough when the handle of the putter golf club is inserted into said tube, said flange having an inner bounding surface.

4. The assembly according to claim 3, wherein said receiver includes a gasket being coupled to said inner bounding surface of said flange, said gasket having an opening extending therethrough, said gasket being aligned with said front side of said flange, said gasket being comprised of a resiliently deformable material, said opening having a diameter being at most equivalent to the diameter of the handle of the putter golf club wherein said gasket is configured to inhibit the handle of the putter golf club from bouncing in said receiver.

5. The assembly according to claim 4, wherein said receiver includes a cushion being coupled to said front side of said flange, said cushion surrounding said inner bounding surface of said flange, said cushion being comprised of a resiliently compressible material, said cushion having the head of the putter golf club being abutted thereagainst when the handle of the putter golf club is inserted into said tube.

6. The assembly according to claim 2, wherein each of said brackets has a primary end and a secondary end, each of said brackets being curved between said primary end and said secondary end thereby facilitating each of said brackets to conform to curvature of said outer wall of said tube, each of said primary end and said secondary end of each of said brackets being fastened to the structure on the golf cart having said tube being horizontally oriented.

7. The assembly according to claim 2, wherein said support is positioned on said outer wall of said tube, said support being positioned closer to said first end of said tube than said second end of said tube, said support being directed downwardly from said tube when said tube is mounted on the structure of the golf cart.

8. A putter holding assembly being configured to store a putter in between holes of golf, said assembly comprising:

a tube having a length of at least 39.0 inches thereby facilitating said tube to accommodate a handle of a putter golf club having a head of the putter golf club being exposed for gripping, said tube having a first end, a second end and an outer wall extending therebetween;

a cap being coupled to said second end of said tube for closing said second end;

a receiver being coupled to said tube, said receiver insertably receiving the handle of the putter golf club when the handle of the putter golf club is inserted into said tube for storage, said receiver comprising:

a flange having a front side and a back side, said back side being coupled around said first end of said tube, said flange having the handle of the putter golf club being inserted therethrough when the handle of the putter golf club is inserted into said tube, said flange having an inner bounding surface;

a gasket being coupled to said inner bounding surface of said flange, said gasket having an opening extending therethrough, said gasket being aligned with said front side of said flange, said gasket being comprised of a resiliently deformable material, said opening having a diameter being at most equivalent to the diameter of the handle of the putter golf club wherein said gasket is configured to inhibit the handle of the putter golf club from bouncing in said receiver; and a cushion being coupled to said front side of said flange, said cushion surrounding said inner bounding surface of said flange, said cushion being comprised of a resiliently compressible material, said cushion having the head of the putter golf club being abutted thereagainst when the handle of the putter golf club is inserted into said tube;

a pair of brackets, each of said brackets being positionable around said tube, each of said brackets engaging a structure on a golf cart for retaining said tube on the golf cart, each of said brackets having a primary end and a secondary end, each of said brackets being curved between said primary end and said secondary end thereby facilitating each of said brackets to conform to curvature of said outer wall of said tube, each of said primary end and said secondary end of each of said brackets being fastened to the structure on the golf cart having said tube being horizontally oriented;

a support being movably coupled to said tube, said support being positioned on said outer wall of said tube, said support being positioned closer to said first end of said tube than said second end of said tube, said support being directed downwardly from said tube when said tube is mounted on the structure of the golf cart; and a towel being coupled to said support wherein said towel is configured to be available to a golfer.

9. The assembly according to claim 8, further comprising a rail being coupled to said outer wall of said tube, said rail being oriented to extend substantially between said first end and said second end of said tube.

* * * * *